US006124754A

United States Patent [19]

Afghahi

[11] Patent Number: 6,124,754

[45] Date of Patent: Sep. 26, 2000

[54] TEMPERATURE COMPENSATED CURRENT AND VOLTAGE REFERENCE CIRCUIT

[75] Inventor: Morteza Afghahi, Tempe, Ariz.

[73] Assignee: Intel Corporation, Santa Clara, Calif.

[21] Appl. No.: 09/303,486

[22] Filed: Apr. 30, 1999

[51] Int. Cl.[7] ..... G05F 1/10

[52] U.S. Cl. ..... 327/538; 327/378; 327/513; 327/530; 323/315; 323/316

[58] Field of Search ..... 327/512, 513, 327/378, 530, 538, 540, 541, 543; 323/312, 315, 316

[56] References Cited

U.S. PATENT DOCUMENTS 5,231,316 7/1993 Thelen, Jr. ..... 327/513
5,281,906 1/1994 Thelen, Jr. ..... 323/313
5,774,013 6/1998 Groe ..... 327/543
5,789,906 8/1998 Mizuide ..... 323/313
5,900,773 5/1999 Susak ..... 327/513
5,955,915 9/1999 Edwards ..... 327/540

*Primary Examiner*—Timothy P. Callahan
*Assistant Examiner*—An T. Luu
*Attorney, Agent, or Firm*—Trop, Pruner & Hu, P.C.

[57] ABSTRACT

A reference circuit includes a first resistive element and a current source. The first resistive element is adapted to produce an output voltage based on a first current and a resistance of the first resistive element. The resistance of the first resistive element is a function of a temperature of the current. The current source includes a second resistive element that has a resistance that is a function of the temperature. The current source is adapted to adjust the first current to minimize variation of the output voltage with the temperature based on the resistance of the second resistive element.

40 Claims, 2 Drawing Sheets

TEMPERATURE COMPENSATED CURRENT AND VOLTAGE REFERENCE CIRCUIT

BACKGROUND

The invention relates to a reference circuit, such as a reference circuit that provides a reference voltage and/or a reference current, for example.

Quite often a circuit may use a reference voltage that is different from available power supply voltage(s). As a result, the circuit may be coupled to another circuit, called a voltage reference circuit, that converts one or more of the available power supply voltage(s) into the desired reference voltage. For example, referring to FIG. 1, a voltage reference circuit 4 may include a resistor divider that is formed from resistors 1 and 2 that are serially coupled together between a positive power supply voltage (called $V_{DD}$) and a negative power supply voltage (called $V_{SS}$). In this manner, an output terminal 3, formed from the union of the two resistors 1 and 2, may provide a reference voltage (called $V_{REF}$) that has a voltage level somewhere between the $V_{DD}$ and $V_{SS}$ power supply voltages.

Assuming that a load that is coupled to the output terminal 3 sinks/sources negligible current, certain circuit applications may benefit from using the voltage reference circuit 4. For example, it may be desirable for the $V_{REF}$ reference voltage to vary proportionately with changes in the levels of the $V_{DD}$ and $V_{SS}$ supply voltages, a feature that is inherent in the resistor divider topology of the voltage reference circuit 4. Furthermore, the resistor divider topology of the voltage reference circuit 4 permits the level of the $V_{REF}$ reference voltage to be substantially low, such as a voltage level in the range of approximately 0.2 to 0.9 volts, for example. The $V_{REF}$ reference voltage may also vary little with a temperature of the voltage reference circuit 4 because a temperature-induced change in the resistance of the resistor 1, 2 is matched by a proportionate change in the resistance of the other resistor 1, 2.

Unfortunately, the resistors 1 and 2 may dissipate excessive power, and as a result, a voltage reference circuit having a different topology may be used. For example, a bandgap voltage reference circuit (not shown) typically dissipates less power. The bandgap voltage reference circuit typically includes one or more p-n junctions that are connected in a manner to provide a reference voltage that varies little with temperature. However, unfortunately, the reference voltage that is provided by the bandgap voltage reference circuit may not vary with the supply voltage(s), the bandgap voltage reference circuit may not produce low reference voltages (e.g., voltages from 0.2 to 0.8 volts), and non-ideal characteristics of the p-n junctions may affect the circuit's performance.

Thus, there is a continuing need for a reference circuit that addresses one or more of the above-stated problems.

SUMMARY

In one embodiment, a reference circuit includes a first resistive element and a current source. The first resistive element is adapted to produce an output voltage based on a first current and a resistance of the first resistive element. The resistance of the first resistive element is a function of a temperature of the reference circuit. The current source includes a second resistive element that has a resistance that is a function of the temperature. The current source is adapted to adjust the first current to minimize variation of the output voltage with the temperature based on the resistance of the second resistive element.

In another embodiment, a method includes routing a first current through a first resistive element to produce an output voltage and changing a resistance of the first resistive element in response to a change in temperature. The resistance of a second resistive element is changed in response to the change in temperature. The change in resistance of the second resistive element is used to regulate the first current to substantially prevent the output voltage from changing when the temperature changes.

DETAILED DESCRIPTION

Figure 1:
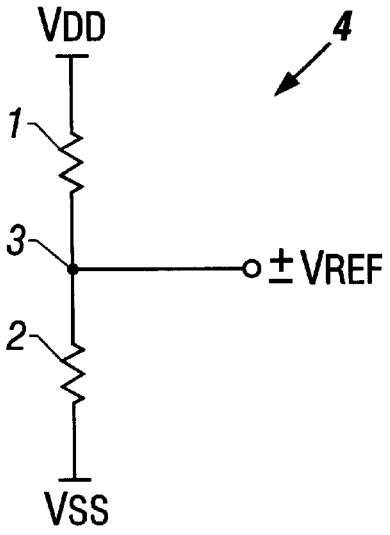
FIG. 1 (PRIOR ART)
FIG. 1 is a schematic diagram of a voltage reference circuit of the prior art
Figure 2:
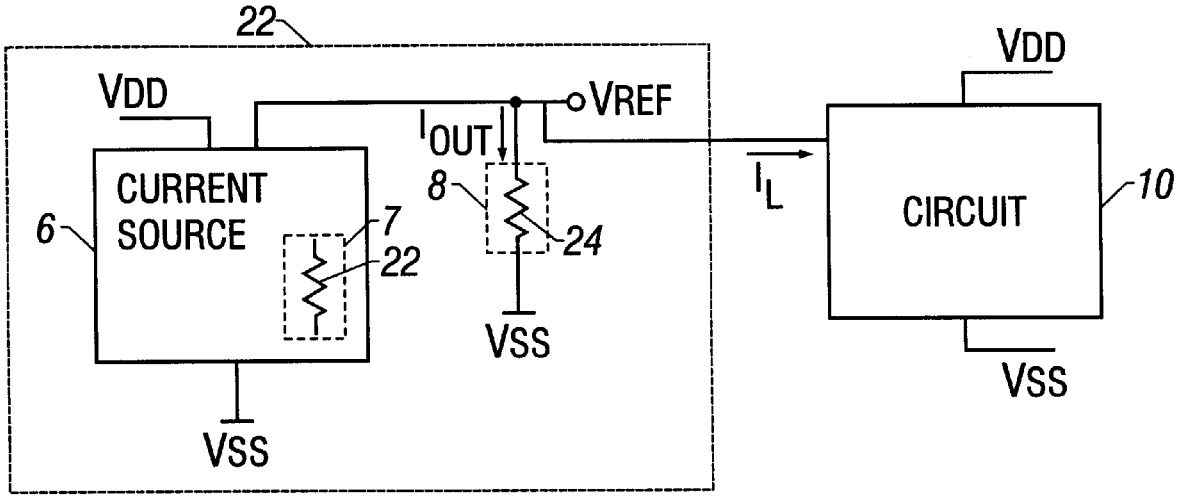
FIG. 2 is a schematic diagram of a reference circuit according to an embodiment of the invention.

Referring to FIG. 2, an embodiment 20 of a reference circuit in accordance with the invention includes a resistive element 8 (a resistor 24, for example) that furnishes a reference voltage (called $V_{REF}$) at an output node 9 of the circuit 20. The $V_{REF}$ reference voltage may be used by another circuit 10, such as a voltage converter, a comparator or an analog-to-digital converter (ADC), as just a few examples. In this manner, the circuit 10 uses a reference voltage that is different from the available power supply voltages. To cause the resistive element 8 to furnish the $V_{REF}$ reference voltage, the reference circuit 20 includes a temperature compensating current source 6 that produces a current (called $I_{OUT}$) in the resistive element 8. As described below, in some embodiments, the current source 6 compensates the $I_{OUT}$ current in a manner that minimizes fluctuations in the level of the $V_{REF}$ reference voltage due to a change in temperature of the reference circuit 20. Furthermore, in some embodiments, the current source 6 may compensate for a change in power supply voltages (a positive power supply voltage called $V_{DD}$ and a negative power supply voltage called $V_{SS}$ (ground, for example), as examples) by proportionally changing the level of the VREF reference voltage. As described below, the reference circuit 20 may accomplish these features while dissipating substantially less power than a conventional resistor divider, for example.

More particularly, when the temperature of the reference circuit 20 changes, the resistance of the resistive element 8 may also change. For example, for embodiments where the resistive element 8 includes a resistor 24, the resistance of the resistor 24 may vary directly with the temperature. Therefore, when the temperature of the reference circuit 20 increases, the resistance of the resistor 24 also increases, a condition that might otherwise increase the $V_{REF}$ reference voltage if not for the current compensation (described below) that is introduced by the current source 6. Similarly, for a decrease in temperature, the resistance of the resistor 24 may decrease, a condition that might otherwise decrease the $V_{REF}$ reference voltage if not for the current compensation that is introduced by the current source 6, described below.

In some embodiments, to compensate the $I_{OUT}$ current, the current source 6 bases the level of the $I_{OUT}$ current on the resistance of a resistive element 7, such as a resistor 22, for example. For example, in some embodiments, the current source 6 may decrease the level of the $I_{OUT}$ current proportionately to the increase in resistance of the resistor 22 and increase the level of the $I_{OUT}$ current proportionately to the decrease in resistance of the resistor 22. In this manner, the level of the $I_{OUT}$ current may vary inversely with the resistance of the resistive element 7, and thus, the level of the $I_{OUT}$ current may vary inversely with the temperature. Therefore, the $I_{OUT}$ current tends to decrease the level of the $V_{REF}$ reference voltage in response to a temperature increase and tends to increase the $V_{REF}$ reference voltage in response to a temperature decrease. Because the level of the $V_{REF}$ voltage may be approximately proportional to the level $I_{OUT}$ current (that tends to vary inversely with the temperature) and may be approximately proportional to the resistance of the resistive element 8 (that tends to vary directly with the temperature), the above-described arrangement may substantially prevent variation of the $V_{REF}$ reference voltage due to changes in temperature.

Because the $V_{REF}$ reference voltage may be formed via a resistive element 8, the above-described arrangement may be used to furnish low voltage level that is close to the $V_{DD}$ or the $V_{SS}$ power supply voltage. For example, for the case where the $V_{SS}$ power supply is approximately ground, the level of the $V_{REF}$ reference voltage may be in the range of approximately 0.2 to 0.8 volts, as an example. Other voltage levels for the $V_{REF}$ reference voltage are possible.

If a bandgap reference circuit is available in the system and a subband gap voltage is needed, the bandgap reference circuit may be used to generate the $V_{DD}$ positive power supply voltage.

Figure 3:
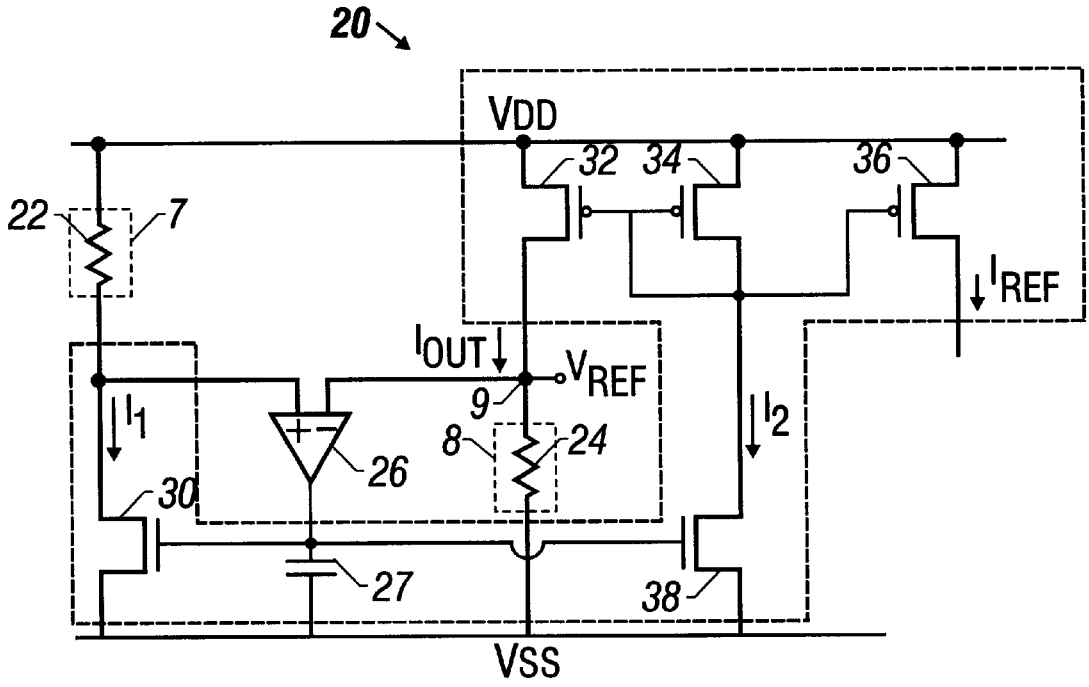
FIGS. 3 and 4 are more detailed schematic diagrams of the reference circuit of FIG. 2 according to different embodiments of the invention.

FIG. 3 depicts a more detailed schematic diagram of the reference circuit 20 in accordance with an embodiment of the invention in which the resistive elements 7 and 8 include resistors 22 and 24, respectively. In particular, the current source 6 may include a current mirror 28, the resistor 22 and an amplifier 26 that electrically interact with each other to regulate the level of the $I_{OUT}$ current, as described below. In this manner, via its input terminals, the amplifier 26 may compare the $V_{REF}$ reference voltage to a voltage of a node 21 that may be set by the voltage drop across the resistor 22. Based on this comparison, the amplifier 26 may regulate an n-channel metal-oxide-semiconductor field-effect-transistor (nMOSFET) 30 (of the current mirror 28) to control the level of a current (called $I_1$) in the resistor 22 and thus, the voltage of the node 21. If the amplifier 26 has a sufficiently high gain, then the voltage of the node 21 is approximately equal to the VREF reference voltage for steady state conditions. It is assumed for purposes of simplifying the discussion of the voltage reference circuit 20 that the input terminals of the amplifier 26 conduct negligible current.

The resistor 22 may be coupled between the $V_{DD}$ positive power supply voltage and the node 21, i.e., two relatively constant voltage levels. As a result of this arrangement, the $I_1$ current varies inversely with the temperature, as the resistance of the resistor 22 varies directly with the temperature.

The current mirror 28 produces the $I_{OUT}$ current by scaling and mirroring the $I_1$ current. To accomplish this, the gate of the transistor 30 may be coupled to the gate of another nMOSFET transistor 38. Because the sources of the transistors 30 and 38 are coupled to the $V_{SS}$ negative power supply voltage, the gate-source voltages of the two transistors 30 and 38 are approximately the same. Therefore, a resultant current (called $I_2$) in the drain-source path of the transistor 38 may mirror the $I_1$ current. The $I_2$ current flows through the source-drain path of a p-channel metal-oxide semiconductor field-effect-transistor (pMOSFET) 34, and in some embodiments, the aspect ratio (i.e., the width-to-length (W/L) ratio of the channel) of a mirroring pMOSFET 36 may be larger than the aspect ratio of the transistor 34 to introduce a current gain that may be described by the following equation:

$$I_{REF}=K\cdot I_2,$$

where $I_{REF}$ is the current in the source-drain path of the transistor 36, "K" is a ratio of the aspect ratio of the transistor 36 to the aspect ratio of the transistor 34. In some embodiments, K may be greater than one.

In some embodiments, the transistor 34 may have its source-drain path coupled in series with the drain-source path of the transistor 38. The gates of the transistors 32, 34 and 36 are coupled together, and the sources of the transistors 32, 34 and 36 are coupled to the $V_{DD}$ positive power supply voltage. The drain-source path of the transistor 32 produces the $I_{OUT}$ current (assuming input terminal of the amplifier 26 sinks/sources negligible current). Therefore, as a result of this arrangement, the $I_{OUT}$ current mirrors the $I_2$ current and thus, mirrors the $I_1$ current. The aspect ratios of the transistors 32 and 34 may be adjusted to further scale the $I_{OUT}$ current with respect to the $I_1$ current.

In some embodiments, the $I_{OUT}$ current has a substantially higher magnitude than the $I_1$ current, a relationship that permits the Icurrent to be small and thus, cause the resistor 22 to dissipate very little power. As a result, the voltage reference circuit 20 may use two resistors 22 and 24 to establish the $V_{REF}$ reference voltage while dissipating substantially less power than a resistor divider topology, for example, that also uses two resistors. However, similar in result to the resistor divider topology, the voltage reference circuit 20 may scale the $V_{REF}$ reference voltage in accordance with a change in the $V_{DD}$ and/or $V_{SS}$ power supply voltages as described by the following equation:

$$V_{REF} = \frac{V_{DD} - V_{SS}}{\frac{R_{22}}{R_{24}K_{TOT}} + 1},$$

where "$R_{22}$" represents the resistance of the resistor 22, and "$R_{24}$" represents the resistance of the resistor 24 and "$K_{TOT}$" represents the total current gain that is applied to the $I_1$ current by the current mirror 28.

Among the other features of the reference circuit 20, the output terminal of the amplifier 26 may be coupled to the gates of the transistors 30 and 38 to regulate the $I_1$, $I_2$ and $I_{OUT}$ currents. The positive input terminal of the amplifier 26 may be coupled to the node 21, and the negative input terminal of the amplifier 26 may be coupled to the output node 9. A capacitor 27 may have one terminal that is coupled to the output terminal of the amplifier 26 and to the gates of the transistors 30 and 38 and another terminal that receives the $V_{SS}$ negative power supply voltage. The capacitor 27 effectively serves as a voltage source to stabilize the level of the $V_{REF}$ reference voltage loop during transient load conditions, for example.

Figure 4:
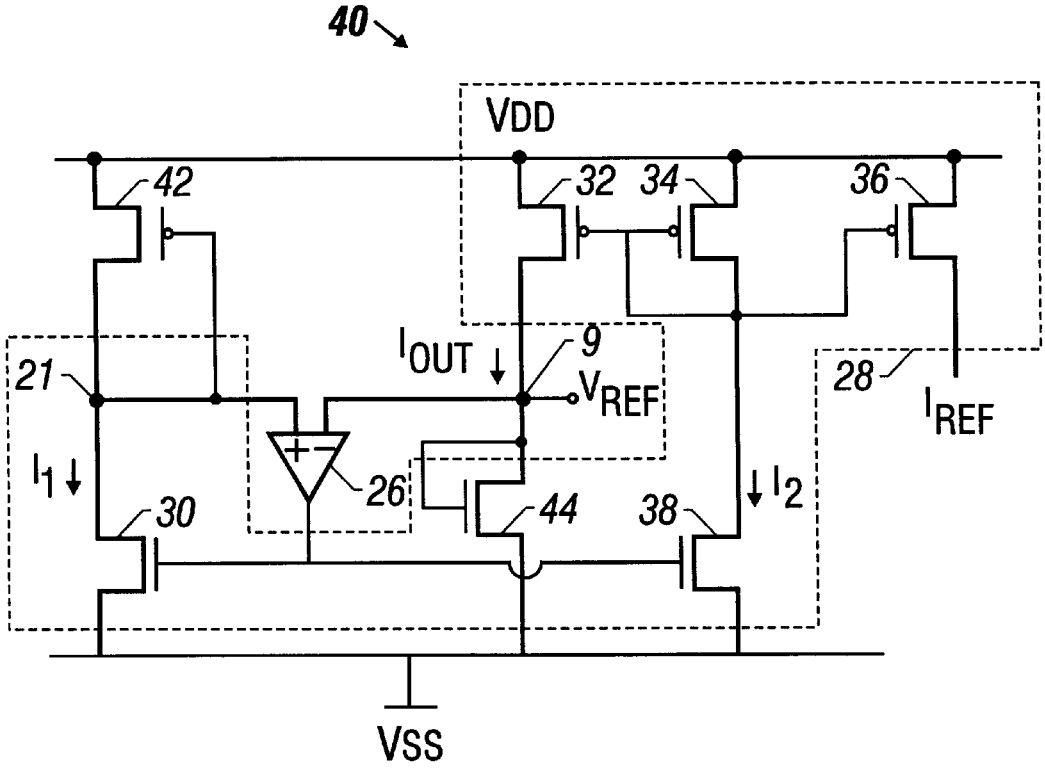

Other embodiments are within the scope of the following claims. For example, referring to FIG. 4, in some embodiments, the voltage reference circuit 20 may be replaced by a voltage reference circuit 40. The voltage reference circuit 40 may be similar in design to the voltage reference circuit 20 except that the resistive elements 7 and 8 may include a pMOSFET transistor 42 and an nMOSFET transistor 44, respectively, that replace the resistors 22 and 24. In this manner, the transistor 42, 44 may be configured as an active load in which the gate of the transistor 42, 44 is coupled to the drain of the transistor 42, 44. Thus, the source-drain path of the transistor 42 is coupled between the $V_{DD}$ positive supply voltage and the node 21; and the drain-source path of the transistor 44 is coupled between the output node 9 and the $V_{DD}$ negative power supply voltage. In some embodiments, the transistor 44 may be replaced by a pMOSFET that has its gate coupled to the $V_{SS}$ negative power supply voltage.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A reference circuit comprising:

a first resistive element adapted to produce an output voltage based on a first current and a resistance of the first resistive element, the resistance of the first resistive element being a function of a temperature of the circuit; and a current source including a second resistive element that has a resistance that is a function of the temperature, the current source adapted to vary the first current with changes in the resistance of the second resistive element to minimize variation of the output voltage with the temperature.

2. The reference circuit of claim 1, wherein the current source comprises:

a current mirror adapted to produce the first current, and the second resistive element being coupled to the current mirror to vary the first current inversely to changes in the resistance of the first resistive element.

3. The reference circuit of claim 1, wherein the second resistive element comprises:

a resistor.

4. The reference circuit of claim 1, wherein the second resistive element comprises:

a transistor.

5. The reference circuit of claim 1, wherein the second resistive element is adapted to provide a second voltage that varies inversely to the output voltage with temperature.

6. The reference circuit of claim 5, further comprising:

an amplifier coupled to the current mirror and adapted to compare the output voltage to the second voltage and adjust the first current based on the comparison.

7. The reference circuit of claim 6, wherein the amplifier comprises a first input terminal coupled to the first resistive element and a second input terminal coupled to the second resistive element.

8. The reference circuit of claim 6, wherein the current mirror comprises a transistor having a current path coupled in series with the second resistive element, and the amplifier is further coupled to the transistor and adapted to regulate a third voltage across the current path to adjust the first current.

9. The reference circuit of claim 1, wherein the current mirror comprises:

at first transistor to receive an indication of the first current; and a second transistor coupled to the first transistor to produce a reference current based on the indication.

10. The reference circuit of claim 1, wherein the first resistive element comprises:

a resistor.

11. The reference circuit of claim 1, wherein the first resistive element comprises:

a transistor.

12. The reference circuit of claim 1, wherein the current source is further adapted to adjust the first current proportionally to changes in a power supply voltage.

13. A method comprising:

routing a first current through a first resistive element to produce an output voltage;

changing a resistance of the first resistive element in response to a change in temperature;

changing a resistance of a second resistive element in response to the change in temperature; and varying the first current in response to the change of resistance of the second resistive element to regulate a level of the first current to substantially prevent the output voltage from changing when the temperature changes.

14. The method of claim 13, wherein the act of varying the first current in response to the change of resistance of the second resistive element comprises:

inversely changing a level of the first current with respect to the change of resistance of the second resistive element.

15. The method of claim 13, wherein the act of using the change of resistance of the second resistive element comprises:

routing a second current through the second resistive element to produce a second voltage;

amplifying a voltage difference between the output voltage and the second voltage; and regulating the level of the first current based on the amplification.

16. The method of claim 13, further comprising:

producing a reference current based on the level of the first current.

17. A system comprising:

a first circuit adapted to receive a reference voltage and a power supply voltage; and a reference voltage circuit comprising:

a first resistive element adapted to produce an output voltage based on a first current and a resistance of the first resistive element, the resistance of the first resistive element being a function of a temperature of the circuit; and a current source adapted to:

vary the first current with changes in the resistance of a second resistive element to minimize variation of the output voltage with the temperature, and adjust the first current to change the reference voltage proportionally to a change in the power supply voltage.

18. The system of claim 17, wherein the current source comprises:

a current mirror adapted to produce the first current;

a second resistive element having a resistance being a function of the temperature of the circuit, the second resistive element coupled to the current mirror to vary the first current inversely to a change in the resistance of the first resistive element.

19. The system of claim 18, wherein the second resistive element is adapted to provide a second voltage that varies inversely with temperature to the output voltage.

20. The system of claim 18, further comprising:

an amplifier coupled to the current mirror and adapted to compare the output voltage to the second voltage and adjust a level of the first current based on the comparison.

21. The system of claim 20, wherein the amplifier comprises a first input terminal coupled to the first resistive element and a second input terminal coupled to the second resistive element.

22. The system of claim 20, wherein the current mirror comprises a transistor having a current path coupled in series with the second resistive element, and the amplifier is further coupled to the transistor and adapted to regulate a third voltage across the current path to adjust a level of the first current.

23. The system of claim 17, wherein the current mirror comprises:

at first transistor to receive an indication of the first current; and a second transistor coupled to the first transistor to produce a reference current based on the indication.

24. A reference circuit comprising:

a first resistive element adapted to produce an output voltage based on a first current and a resistance of the first resistive element, the resistance of the first resistive element being a function of a temperature of the circuit; and a current source comprising:

a current mirror adapted to produce the first current; and a second resistive element being coupled to the current mirror to vary the first current inversely to changes in the resistance of the first resistive element to minimize variation of the output voltage with the temperature.

25. The reference circuit of claim 24, wherein the second resistive element comprises:

a resistor.

26. The reference circuit of claim 24, wherein the second resistive element comprises:

a transistor.

27. The reference circuit of claim 24, wherein the second resistive element is adapted to provide a second voltage that varies inversely to the output voltage with temperature.

28. The reference circuit of claim 27, further comprising:

an amplifier coupled to the current mirror and adapted to compare the output voltage to the second voltage and adjust the first current based on the comparison.

29. The reference circuit of claim 28, wherein the amplifier comprises a first input terminal coupled to the first resistive element and a second input terminal coupled to the second resistive element.

30. The reference circuit of claim 28, wherein the current mirror comprises a transistor having a current path coupled in series with the second resistive element, and the amplifier is further coupled to the transistor and adapted to regulate a third voltage across the current path to adjust the first current.

31. The reference circuit of claim 24, wherein the current mirror comprises:

at first transistor to receive an indication of the first current; and a second transistor coupled to the first transistor to produce a reference current based on the indication.

32. The reference circuit of claim 24, wherein the first resistive element comprises:

a resistor.

33. The reference circuit of claim 24, wherein the first resistive element comprises:

a transistor.

34. The reference circuit of claim 24, wherein the current source is further adapted to adjust the first current proportionally to changes in a power supply voltage.

35. A system comprising:

a first circuit adapted to receive a reference voltage and a power supply voltage; and a reference voltage circuit comprising:

a first resistive element adapted to produce an output voltage based on a first current and a resistance of the first resistive element, the resistance of the first resistive element being a function of a temperature of the circuit; and a current source comprising:

a current mirror adapted to produce the first current; and a second resistive element being coupled to the current mirror to vary the first current inversely to changes in the resistance of the first resistive element to minimize variation of the output voltage with the temperature.

36. The system of claim 35, wherein the second resistive element is adapted to provide a second voltage that varies inversely with temperature to the output voltage.

37. The system of claim 35, further comprising:

an amplifier coupled to the current mirror and adapted to compare the output voltage to the second voltage and adjust a level of the first current based on the comparison.

38. The system of claim 37, wherein the amplifier comprises a first input terminal coupled to the first resistive element and a second input terminal coupled to the second resistive element.

39. The system of claim 37, wherein the current mirror comprises a transistor having a current path coupled in series with the second resistive element, and the amplifier is further coupled to the transistor and adapted to regulate a third voltage across the current path to adjust a level of the first current.

40. The system of claim 35, wherein the current mirror comprises:

at first transistor to receive an indication of the first current; and a second transistor coupled to the first transistor to produce a reference current based on the indication.

* * * * *